US007306525B2

(12) United States Patent
Sawada

(10) Patent No.: US 7,306,525 B2
(45) Date of Patent: Dec. 11, 2007

(54) GOLF PUTTING PRACTICE DEVICE

(75) Inventor: Eju Sawada, 1-14-19-1302, Tamadaira, Hino-shi, Tokyo (JP)

(73) Assignees: Eju Sawada, Tokyo (JP); Azden Corporation, Tokyo (JP)

( * ) Notice: Subject to any disclaimer, the term of this patent is extended or adjusted under 35 U.S.C. 154(b) by 0 days.

(21) Appl. No.: 11/354,832

(22) Filed: Feb. 16, 2006

(65) Prior Publication Data

US 2006/0189402 A1 Aug. 24, 2006

(30) Foreign Application Priority Data

Feb. 18, 2005 (JP) ..... 2005-075875
Aug. 23, 2005 (JP) ..... 2005-240528

(51) Int. Cl.
*A63B 69/36* (2006.01)

(52) U.S. Cl. ..... 473/212; 473/220; 473/207; 473/268

(58) Field of Classification Search ..... 473/207, 473/208, 209, 212, 213, 214, 215, 220, 268, 473/266, 269
See application file for complete search history.

(56) References Cited

U.S. PATENT DOCUMENTS

| | | | | |
|---|---|---|---|---|
| 4,456,257 | A * | 6/1984 | Perkins | 473/220 |
| 5,284,345 | A * | 2/1994 | Jehn | 473/209 |
| 6,238,298 | B1 * | 5/2001 | Chen | 473/220 |
| 6,467,929 | B2 * | 10/2002 | Lee | 362/191 |
| 6,605,005 | B1 * | 8/2003 | Lin | 473/220 |
| 2004/0106462 | A1 * | 6/2004 | Ianazone | 473/268 |

FOREIGN PATENT DOCUMENTS

JP A-09-154995 6/1997

* cited by examiner

*Primary Examiner*—Nini F. Legesse
(74) *Attorney, Agent, or Firm*—Oliff & Berridge, PLC

(57) ABSTRACT

A golf putting practice device to be used as being attached to a part of a body of a golfer is provided. The golf putting practice device includes: a laser indicator that irradiates a laser beam; an arm band that detachably attaches the laser indicator to an arm of the golfer, a free platform that connects the laser indicator to the arm band and adjusts an angle of the laser indicator; and a sliding attachment/detachment device used for attachment and detachment of the laser indicator and used together with an attachment member being provided at an end of the free platform and being configured so as to be pushed into and pulled out of the sliding attachment/detachment device.

4 Claims, 4 Drawing Sheets

GOLF PUTTING PRACTICE DEVICE

INCORPORATION BY REFERENCE

The disclosure of Japanese Patent Application No. 2005-240528 filed on Aug. 23, 2005 including the specification drawings and abstract is incorporated herein by reference in its entirety.

BACKGROUND OF THE INVENTION

1. Field of the Invention

The present invention relates to a golf putting practice device to be used as being attached to a part of the body of a golfer.

More specifically, the present invention relates to a putting practice device that indicates, on the ground or on a putter, the movement of the player's body, using a laser indicator.

2. Description of the Related Art

Putting practice devices that are publicly known enable a player to correct the addressing of a ball during a putting stroke, enable a player to learn a proper form by checking the positions of a ball and the player's eye level, or indicate a direction into which a ball should be putted using a laser pointer.

However, the known putting practice devices have problems as follows:

(a) The player is able to practice and team some parts of the motion by looking at only the result of a stroke motion during a putting stroke. The player, however, is not able to judge and learn if the motion of the whole body is good or bad.

(b) The player is not able to analyze the causes of a bad putting stroke (a bad motion).

(c) Because the putting practice device restrains or constrains the player's body or arms, the player is not able to make a stroke as naturally as he/she would on an actual green.

(d) Portability of the putting practice devices is low, and it is inconvenient to use the device on a practice green before an actual golf game starts.

(e) It is difficult for the player to attain an accurate sense of distance.

(f) The player is not able to practice strokes unless he/she has a putter and a ball with him/her.

As an example, JP-A-9-154995 (1997) proposes a golf practice target pointing device which irradiates a laser beam onto a golf ball from the side of a player's head while the player practices his/her swings and putting strokes and by which the optical axis can be adjusted easily so that the player is able to try to keep his/her head, which is the rotation axis in a swing, from swaying.

According to the method disclosed in JP-A-9-154995 (1997), it is possible to check to see if the rotation axis of a swing is kept in the same position; however, a player is not able to check to see if his/her arms, elbows, and wrists maintain the same form during a shoulder putting stroke, which that the form of the wrists, the arms, and the elbows is fixed. Accordingly, with this method, the player is not able to learn a pendulum-like stoke in a perfect manner. Also, according to this method, the player is not able to check the direction of his/her stroke and to learn a proper stroke.

SUMMARY OF THE INVENTION

The present invention aims to solve the problems found in the related art and to provide a golf putting practice device that enables a player to check to see if the arms, the elbows, and the wrists maintain the same form during a shoulder putting stroke, which requires that the form of the wrists, the arms, and the elbows is fixed while a stroke is made with the rotation of the shoulders.

To be more specific, the present invention aims to provide a golf putting practice device that enables a player to check and learn if the conditions to perform a perfect shoulder putting stroke are satisfied, the conditions being namely (1) the supporting point (the axis) stays in the same position, and (2) the wrists, the arms, and the elbows maintain the same form throughout the whole process of a stroke, and also enables the player to check the direction of strokes and to learn a proper stroke.

The present invention is able to solve the problems mentioned above, and the gist of the present invention is defined in the patent claims and as described below:

(1) A golf putting practice device to be used as being attached to a part of a body of a golfer, the golf putting practice device comprising:
- a laser indicator that irradiates a laser beam;
- an arm band that detachably attaches the laser indicator to an arm of the golfer;
- a free platform that connects the laser indicator to the arm band and adjusts an angle of the laser indicator; and
- a sliding attachment/detachment device that is used for attachment and detachment of the laser indicator and used together with an attachment member being provided at an end of the free platform and being configured so as to be pushed into and pulled out of the sliding attachment/detachment device.

(2) The golf putting practice device according to (1), further comprising:
- a clip for attaching the laser indicator to one of a brim of a hat, a brim of a cap, and a belt.

(3) The golf putting practice device according to (1) or (2), wherein
- the laser indicator has a function to allow a laser emission mode to be switched to one of a spot laser mode and a line laser mode.

According to the present invention, significant effects that are industrially useful as described below are achieved:

Firstly, when the practice device of the present invention is used as being attached to a part of a players body, the player is able to practice so as to make a proper stroke motion, in other words, to make an arc-like motion using the neck bone as a supporting point while the arms, the elbows, and the putter stay together. Thus, the player is able to learn to make a stroke in an accurate direction.

Secondly, the practice device enables a player to practice while preventing unnecessary movement of the knees, the lower back, the buttocks, the elbows, the wrists, the head, and the eye level, which may be one of the reasons for not being able to make a proper stroke. Once a player learns a proper stroke, the player will be able to make strokes with a constant speed. The player will then be able to attain a sense of distance easily because by changing the width of the swing in each stroke, he/she can learn how far the ball rolls in relation to the width of the swing.

Thirdly, the practice device of the present invention has high portability, and the application of laser beams makes it possible to achieve the same effects even when the practice device is used on turf. Thus, the player is able to take the practice device to a practice green provided near a golf course and to practice effectively before the actual round starts. Further, when a player has this practice device with him/her, he/she is able to practice strokes anywhere without using a putter or a ball.

BRIEF DESCRIPTION OF TIE DRAWINGS

DETAILED DESCRIPTION OF THE PREFERRED EMBODIMENTS

The following describes the preferred embodiments of the present invention with reference to FIG. 1 through FIG. 8.

Figure 1:
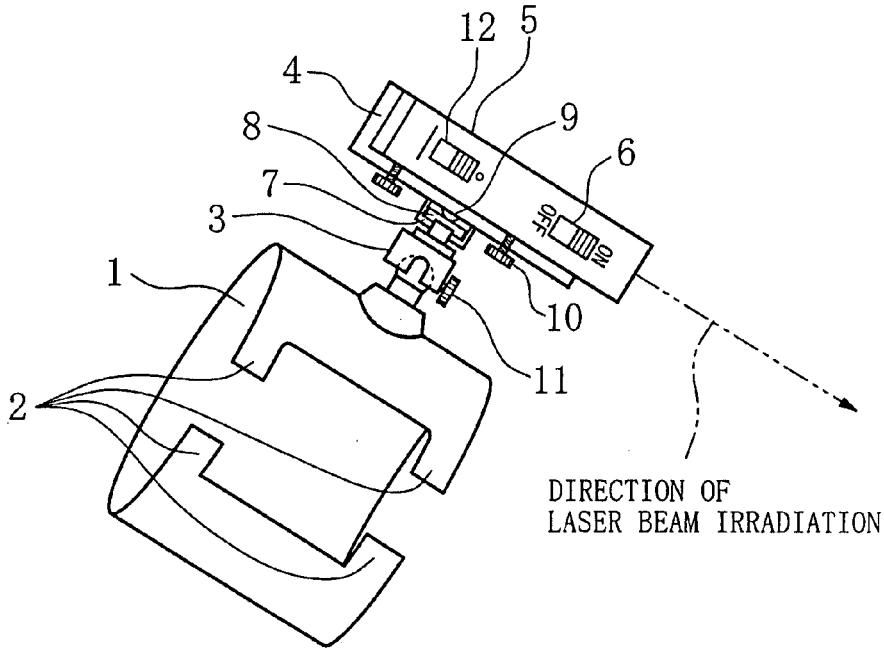
FIG. 1 is a perspective view of an embodiment of a putting practice device according to the present invention.
Figure 8:
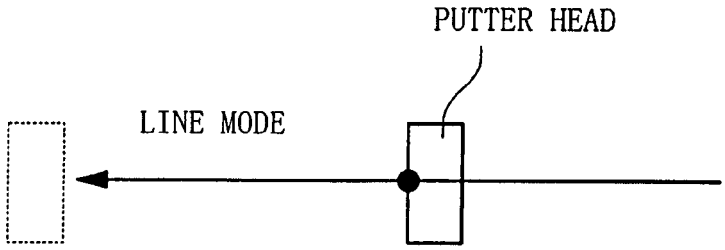
FIG. 8 is a drawing of an embodiment in which the laser emission mode of the putting practice device according to the present invention is set to a line laser mode.

In FIG. 1 trough FIG. 8, the reference characters denote the following elements respectively: 1: an arm band; 2: claws; 3: a semi-flexible connecting unit (a free platform), 4: a laser indicator fixing unit; 5: a laser indicator, 6: an electric power switch; 7: an attachment member; 8: a sliding attachment/detachment device; 9: a spring; 10: a fixing screw; 11: a friction a screw; 12: a mode changing switch; 13: a clip used for attaching the laser indicator fixing unit 4 to a brim of a hat/cap; and 14: a clip used for attaching the laser indicator fixing unit 4 to a belt.

As shown in FIG. 1, a golf putting practice device according to the present invention is used as being attached to a part of the body of a golfer and includes the laser indicator 5 that irradiates a laser beam, the arm band 1 that detachably attaches the laser indicator 5 to an arm of a player, a free platform 3 that connects the laser indicator 5 to the arm band 1 and adjusts the angle of the laser indicator 5, and the sliding attachment/detachment device 8 that is used for attachment and detachment of the laser indicator 5 and used together with the attachment member 7 being provided at an end of the free platform 3 and being configured so as to be pushed into and pulled out of the sliding attachment/detachment device 8.

The golf practice target pointing device disclosed in JP-A-9-154995 (1997) is designed to be used as being attached to the side of a sun hat or the like. In this example, because the laser indicator is not expected to be shaken very much during a putting stroke, it is possible to detachably attach the practice device in a simple manner, using a Magic Tape (a registered trademark) or the like. However, when a golf putting practice device is designed to be attached to the arm of a player like in the example according to the present invention, the laser indicator 5 is expected to be shaken to a large extent during a putting stroke. Accordingly, the golf putting practice device according to the present invention is configured so as to include the arm band 1 that detachably attaches the laser indicator 5 to the arm of a player, the free platform 3 that connects the laser indicator 5 to the arm band 1 and adjusts the angle of the laser indicator 5, and the sliding attachment/detachment device 8 that is used for attachment and detachment of the laser indicator 5 and used together with the attachment member 7 being provided at an end of the free platform 3 and being configured to be pushed into and pulled out of the sliding attachment/detachment device 8. With this arrangement, it is possible to fix the laser indicator 5 to the player's arm firmly so that it does not fall off easily, and also it is easy to adjust the pointing direction of the laser beam because the direction of the laser indicator 5 can be changed as desired, not only in the direction in which the axis of the arm extends, but also in a direction perpendicular to the direction in which the axis of the arm extends.

To be more specific, because the free platform 3 includes a ball joint as shown in FIG. 1, it is possible to change the direction of the laser indicator 5 by changing the angle of the free platform 3, as necessary, not only in the direction in which the axis of the arm extends, but also in a direction perpendicular to the direction in which the axis of the arm extends.

Also, by adjusting the degree of tightness of the ball joint by turning the friction adjusting screw 11, it is possible to assure a deformation resistance that is sufficient to prevent the laser indicator 5 from changing its form even if it is shaken during a putting stroke, and it is also possible to adjust the laser beam irradiation position freely, so that the laser been points to a direction desired by the player.

Further, it is easy to attach and detach the laser indicator 5 because of the arrangements in which the free platform 3 is positioned on the side of the arm band 1 and the attachment member 7 is provided on one end of the free platform 3. To attach the laser indicator 5, the attachment member 7 provided at the end of the free platform 3 is pushed into the sliding attachment/detachment device 8. To detach the laser indicator 5, the attachment member 7 provided at the end of the free platform 3 is pulled out of the sliding attachment/detachment device 8.

For example, as shown in FIG. 1, it is preferable to have a configuration in which the attachment member 7 is provided on one end of the free platform 3 so that the laser indicator 5 can be attached and detached with the use of the attachment member 7, which is configured so as to be pushed into the sliding attachment/detachment device 8 and held by the spring 9 provided on the sliding attachment/detachment device 8 side.

It is also preferable to configure the arm band 1 so as to include a strengthening member such as a copper plate or the like so that the arm band 1 has no flexibility in the direction in which the player's arm extends. Also, it is preferable that the arm band 1 is made of a semi-flexible material so that, in terms of a direction perpendicular to the arm, it can be rolled around and fixed onto the arm of a player.

Because the laser indicator fixing unit 4 includes the fixing screw 10 for fixing the laser indicator 5, the clip 13 for fixing the laser indicator fixing unit 4 onto a brim of a hat/cap, and the clip 14 for attaching the laser indicator firing unit 4 to a belt, it is possible to attach the laser indicator 5 not only to a player's arm, but also to a hat/cap or a belt.

With this arrangement, the player is able to check to see, during a putting stroke, if the supporting point in a rotation using the neck bone as the rotation axis stays in the same position, and if the lower half of the body does not make any unnecessary movement.

A shown in FIG. 1, after the laser indicator 5 is firmly fixed to the laser indicator fixing unit 4, the arm band 1 is attached to one of the upper arm and the lower arm of a player so that the laser indicator 5 is positioned facing away from the body, by putting the claws 2 of the arm band 1 together. Subsequently, a semi-flexible portion of the free platform 3 is adjusted so that a laser beam emitted from the laser indicator 5 points to a part of the putter head while the player is addressing a ball. It should be noted that FIG. 1 merely shows an example of the configuration. The arm band 1 may be fixed to the arm of a player using a hook-and-loop fastener made of a cloth material, instead of the claws 2. The laser indicator 5 may be fixed to the laser indicator fixing unit 4 using a rubber band or a tie strap instead of the fixing screw 10.

Figure 2:
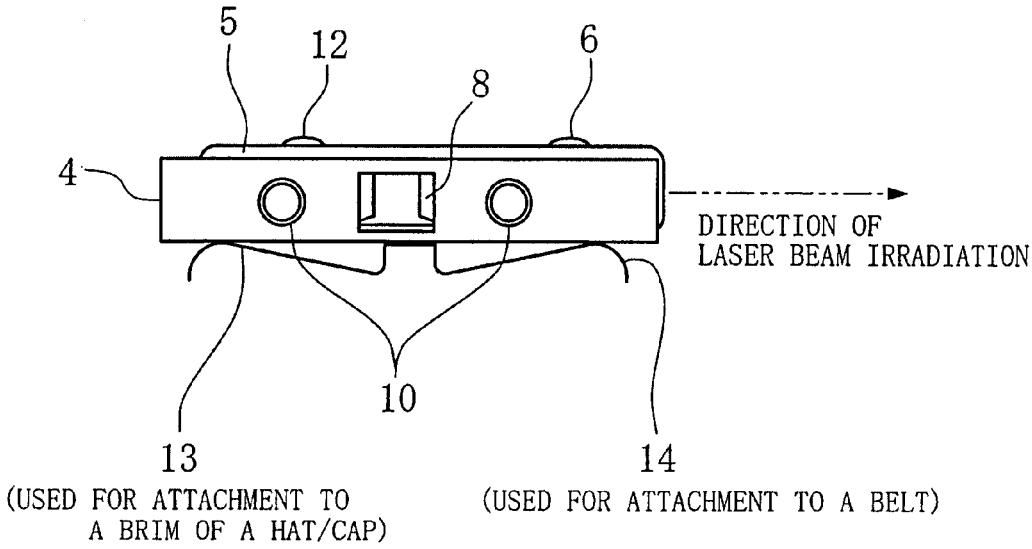
FIG. 2 is a rear view of a laser indicator fixing unit 4 included in the putting practice device according to the present invention.

As shown in FIG. 1 and FIG. 2, the laser indicator 5 includes an electric power source, an oscillation circuit, and a light emitting element, and the like. The laser indicator 5 also has the sliding electric power switch 6 so that a player is able to turn on and off the laser irradiation as necessary. In addition, the laser indicator 5 also has the mode changing switch 12, as described later, so that the player is able to select, as the laser emission mode, one of a spot laser mode and a line laser mode.

In FIG. 1 and FIG. 2, the laser indicator 5 and the laser indicator fixing unit 4 are configured to be separate elements; however, it is acceptable to incorporate the laser indicator fixing unit 4 into the laser indicator 5.

Figure 3:
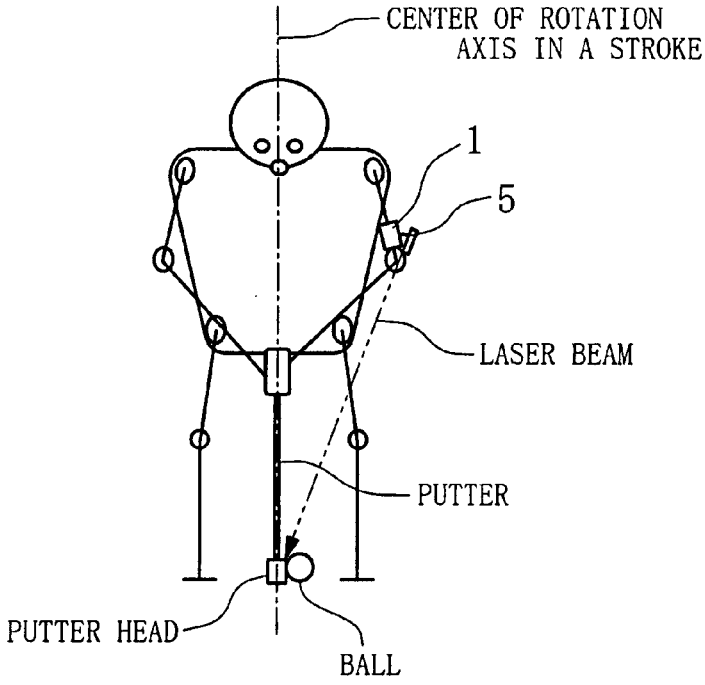
FIG. 3 is a front view showing how the putting practice device according to the present invention is attached to the left upper arm of a player.
Figure 4:
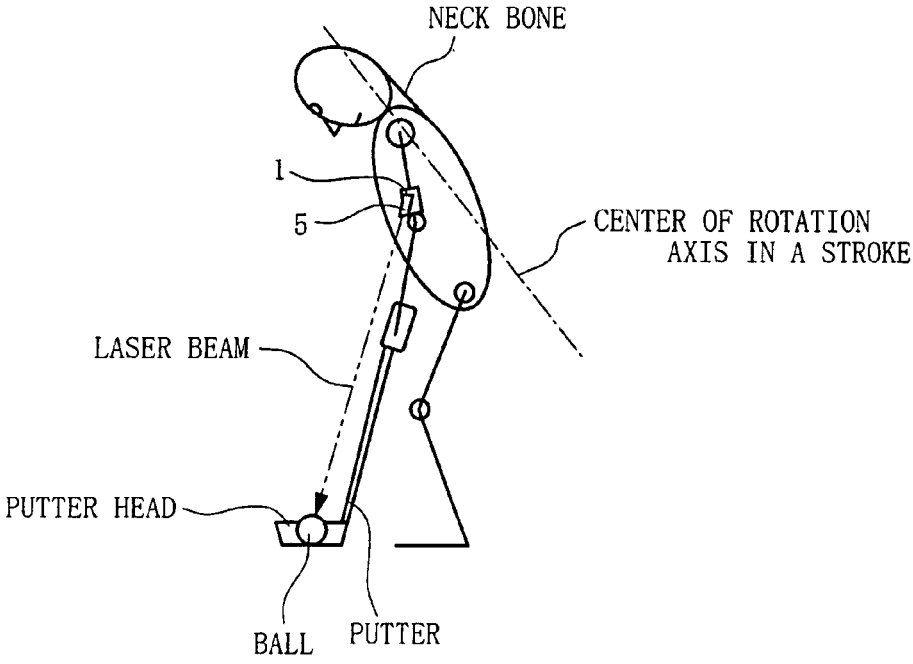
FIG. 4 is a side view showing how the putting practice device according to the present invention is attached to the left upper arm of a player.
Figure 5:
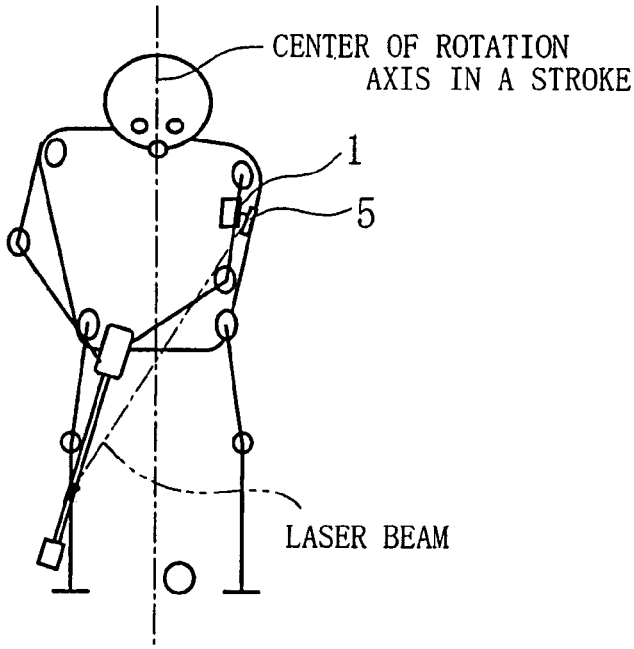
FIG. 5 is a front view showing how the putting practice device according to the present invention is attached to the left upper arm of a player during a take back.

A putting stoke includes a motion called a "take back", that is, to draw a putter head away from a ball in a direction opposite to the direction of the cup and a motion to strike in a direction toward the cup (including the downswing the impact, the follow-through, and the finish). Of different types of putting strokes, it is difficult to learn a proper motion (that yields an accurate stroke in terms of the direction and the distance) for a shoulder putting stroke (a putting stroke made with movement of shoulders using the neck bone as a rotation axis) which requires that form of the wrists, the arms, and the elbows is fixed, because the wrists, the grip, or the elbows tend to make unnecessary movement during a stroke. As shown in FIGS. 3 through 5, with the use of the practice device of the present invention, when the laser beam irradiation is kept at one specific point on the putter head throughout the whole process of a stroke, it means that the stroke is being performed with a proper form. Thus, the player is able to practice strokes by trying to keep the laser bean irradiation at one specific point on the putter.

When a putter head has a structure on which the laser beam reflects, and the reflection may bother the player's eyes or the eyes of other people around the player, it is possible to achieve the same effect by changing the setting so that the laser beam irradiates at a point on the green or on a practice mat positioned away from a putter head by a predetermined distance, instead of the setting to irradiate at a specific point on a putter head. In this arrangement, the player is able to achieve the same effect by trying to keep, during a stroke, the distance between the laser beam irradiation point and the putter head constant.

When a player practices with the practice device attached to the lower arm, it is possible to learn the proper motions for the wrists and the grip (i.e. the motions in which the wrists and the grip do not change the form throughout the whole process of a stroke). After learning the proper motions for the wrists and the grip this way, the player may attach the practice device on the upper arm to learn the proper motions for the elbows. A right-handed player is able to learn a proper shoulder putting form by attach the practice device on the left arm. If the player finds that this is not sufficient, the player can learn, at first, a proper motion for the left arm, and then attach the practice device on the right arm, in order to learn a proper motion for both arms more efficiently. A left-handed player can practice using the same procedure in which the left and the right are reversed.

Figure 6:
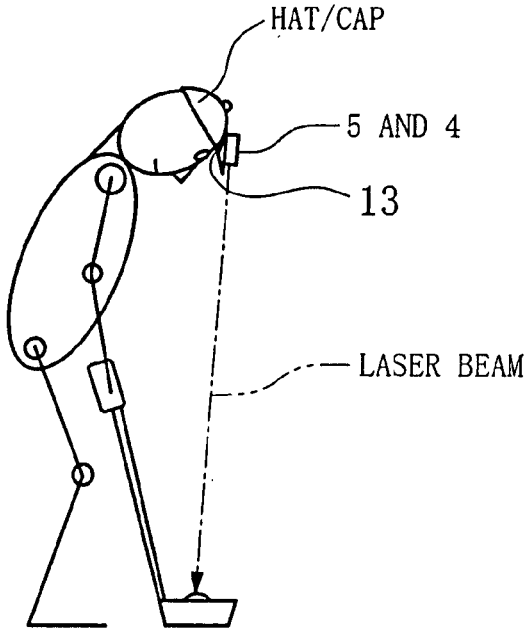
FIG. 6 is a side view showing how the putting practice device according to the present invention is attached to a brim of a hat/cap.

As shown m FIG. 6, it is also acceptable to remove the laser indicator fixing unit 4 from the free platform 3 and to attach the laser indicator fixing unit 4 firmly to a brim of a golf hat/cap using the clip 13. A player is able to practice by making a stroke so that the laser beam irradiates on a ball or a point positioned near the ball during the addressing of the ball and trying to keep the laser beam irradiation spot at the same position throughout the whole process of the stroke. This way, the player is able to learn, in a perfect manner, how to prevent the head from shifting upward and how to prevent the body from making unnecessary movement. In addition, since a beginner player tends to have unnecessary knee movement during a stroke, it is also very effective to attach the practice device on a knee or at a position near a knee, using the arm band 1, in order to avoid the problem.

When the laser indicator fixing nit 4 is used as being attached to a belt using the clip 14, a player is able to practice to learn how to prevent the lower body, the buttocks, and the lower back from making unnecessary movement.

According to the methods described above, it is possible to easily learn how to make a stroke without unnecessary movement of the body, in other words, without unnecessary movement of the body and the rotation axis, for any other variation of strokes in addition to a shoulder putting stroke, using various types of putters including a mid-length putter (known as a belly putter) or a long putter.

Further, it is preferable to have an arrangement in which the laser indicator 5 has a function to allow the laser emission mode to be switched to one of a spot laser mode and a line laser mode.

Figure 7:
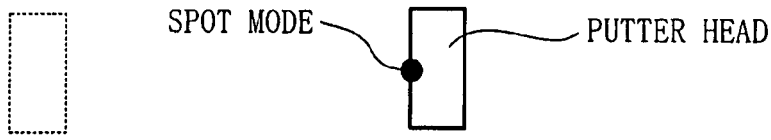
FIG. 7 is a drawing of an embodiment in which the laser emission mode of the putting practice device according to the present invention is set to a spot laser mode.

As shown in FIG. 7, when the laser emission mode is switched to the spot laser mode, it is possible to indicate the laser irradiation point with a greater degree of accuracy, and a player is able to check to see if the spot laser properly overlaps the putter head and also to check to see if the laser irradiation point has not changed each stroke.

As shown in FIG. 8, when the laser emission mode is switched to the line laser mode, it is possible to indicate a direction in which a putter head should be moved. Thus, in this mode, a player is able to learn how to improve the straightness of his/her strokes even more efficiently.

What is claimed is:

1. A golf putting practice device to be used as being attached to a part of a body of a golfer, the golf putting practice device comprising:

a laser indicator that irradiates a laser beam;

an arm band that detachably attaches the laser indicator to an arm of the golfer;

a free platform that connects the laser indicator to the arm band and adjusts an angle of the laser indicator relative to the arm band; and a sliding attachment/detachment device that is attached to the indicator and is used for attachment and detachment of the laser indicator to the platform by selectively engaging with an attachment member that is provided at an end of the free platform and that is configured so as to be pushed into and pulled out of the sliding attachment/detachment device.

2. The golf putting practice device according to claim 1, further comprising: a clip for attaching the laser indicator to one of a brim of a hat, a brim of a cap, and a belt.

3. The golf putting practice device according to claim 2, wherein the laser indicator has a function to allow a laser emission mode to be switched to one of a spot laser mode and a line laser mode.

4. The golf putting practice device according to claim 1, wherein the laser indicator has a function to allow a laser emission mode to be switched to one of a spot laser mode and a line laser mode.

* * * * *